US006901994B1

(12) United States Patent
Jin-Cherng et al.

(10) Patent No.: US 6,901,994 B1
(45) Date of Patent: Jun. 7, 2005

(54) FLAT HEAT PIPE PROVIDED WITH MEANS TO ENHANCE HEAT TRANSFER THEREOF

(75) Inventors: Shyu Jin-Cherng, Pingtung (TW); Lin Che-Wei, Hsinchu (TW); Yeh Lan-Kai, Kaohsiung (TW); Tsai Ming-Jye, Hsinchu (TW); Chen Shao-Wen, Fongyuan (TW); Chung Cheng-Tai, Sinjhuang (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/753,029

(22) Filed: Jan. 5, 2004

(51) Int. Cl.[7] ..... F28F 15/00

(52) U.S. Cl. ..... 165/104.26; 165/185; 165/104.33; 361/700; 174/15.2; 257/715

(58) Field of Search ..... 165/104.26, 104.21, 165/104.33, 185; 361/699, 700; 257/714–716; 174/15.2

(56) References Cited

U.S. PATENT DOCUMENTS

| | | | | | |
|---|---|---|---|---|---|
| 3,680,189 | A * | 8/1972 | Noren | ..... | 29/890.032 |
| 4,046,190 | A * | 9/1977 | Marcus et al. | ..... | 165/104.26 |
| 5,465,782 | A * | 11/1995 | Sun et al. | ..... | 165/104.26 |
| 6,056,044 | A * | 5/2000 | Benson et al. | ..... | 165/104.26 |
| 6,082,443 | A * | 7/2000 | Yamamoto et al. | .... | 165/104.26 |
| 6,269,866 | B1 * | 8/2001 | Yamamoto et al. | .... | 165/104.26 |
| 6,293,333 | B1 * | 9/2001 | Ponnappan et al. | .... | 165/104.26 |
| 6,397,935 | B1 * | 6/2002 | Yamamoto et al. | .... | 165/104.26 |
| 2001/0004934 | A1 * | 6/2001 | Yamamoto et al. | .... | 165/104.11 |
| 2004/0069455 | A1 * | 4/2004 | Lindemuth et al. | .... | 165/104.15 |

FOREIGN PATENT DOCUMENTS

| | | | | |
|---|---|---|---|---|
| JP | 11-183067 | * 7/1999 | ..... | 165 104.26 |
| JP | 2001-339026 | * 12/2001 | ..... | 165 104.26 |
| JP | 2002-62067 | * 2/2002 | ..... | 165 104.26 |

* cited by examiner

*Primary Examiner*—Terrell McKinnon
(74) *Attorney, Agent, or Firm*—W. Wayne Liauh

(57) ABSTRACT

A flat heat pipe has a vacuum chamber, an evaporator connected to a heating element, and a condenser connected to a cooling device. The vacuum chamber is provided in an interior with a wick structure and a working fluid by which an evaporation-condensation cyclic process is effected. The vacuum chamber is further provided in the interior with a plurality of heat conduction pillars, which are confined to the area of the evaporator and are connected with an upper wall and a lower wall of the interior of the chamber. The heat conduction pillars serve to enhance the heat conduction to the condenser from the evaporator.

6 Claims, 8 Drawing Sheets

FLAT HEAT PIPE PROVIDED WITH MEANS TO ENHANCE HEAT TRANSFER THEREOF

FIELD OF THE INVENTION

The present invention relates generally to a flat heat pipe, and more particularly to a structure for enhancing heat transfer of the flat heat pipe. The structure comprises a plurality of heat conduction pillars, which are located in a hot spot area of a chamber of the flat heat pipe in such a way that the heat conduction pillars are extended between an upper wall and a lower wall of the hot spot area of the chamber. The heat conduction pillars serve to attain heat dissipation and uniform temperature distribution of the flat heat pipe.

BACKGROUND OF THE INVENTION

The state-of-the-art electronic device comprises a number of the miniaturized electronic components per unit volume. These electronic components are highly efficient and capable of high performance, thereby resulting in massive generation of heat in the course of their operation. In light of design variation of the electronic components, the heat flux distribution on the surface of the electronic components is apt to be uneven, so as to form the so-called "hot spot" on the surface of the electronic components. Such a locally over-heating phenomenon is detrimental to reliability and longevity of a highly-sophisticated electronic device, such as notebook computer.

In order to prepare for advent of electronic products of new generation, a number of passive cooling elements have been introduced into the market place. These passive cooling elements have the same working principle. As shown in FIG. 1, a vacuum chamber 1 is provided in the surface of an interior thereof with a wick structure 2. Meanwhile, the vacuum chamber 1 is provided with a working fluid, which is distributed on the wick structure 2 by virtue of capillarity. As the chamber 1 comes in contact with a heat source, the working fluid is heated by the heat source to evaporate to remain in the form of vapor. When the working fluid vapor comes in contact with a cooler portion of the chamber, the working fluid vapor condenses to remain in the form of liquid. The liquid is then guided to the wick structure containing lesser amount of liquid by virtue of capillary force brought about by the wick structure. As a result, a subsequent cycle of evaporation and condensation is effected such that the heat is transferred from a hotter region to a colder region, with a minute change in temperature. It is therefore readily apparent that the wick structure is critical to the design of the passive elements described above, and that the wick structure serves as a passage of the liquid as well as a driving force of the liquid. As a result, a liquid/vapor dual phase cycle of the working fluid takes place smoothly in the vacuum chamber. However, the wick structure is also an obstacle to heat transfer due to its low thermal conductivity. In another words, the liquid which is attracted to the wick structure would fail to vaporize as expected, thereby resulting in a poor heat dissipation or heat distribution.

As shown in FIG. 2, the Taiwan Patent Serial No.89210557 discloses a flat heat pipe comprising a vacuum chamber 3 in which an appropriate amount of a working fluid is contained. The vacuum chamber 3 is provided with a plurality of wick structures 4, which are connected with an upper wall and a lower wall of the chamber 3 for enhancing the structural strength of the flat heat pipe, and for increasing the number and the surface area of the wick structure. In spite of the high-density distribution of the wick structure to promote the flow of the condensate, the wick structure is in fact an obstacle to heat transfer due to the fact that the wick structure is relatively low in thermal conductivity. This prior art flat heat pipe is ineffective in heat transfer of the electronic components, especially those electronic components which generate heat unevenly to form hot spots.

The Taiwan Patent Serial Number 86115415 discloses a cooling device comprising a chamber 5 in which an appropriate amount of working fluid is contained, as illustrated in FIG. 3. The chamber 5 is provided with a number of cooling fins 6, fluid conduction pillars 7, and wick structures 8. The fluid conduction pillars 7 serve a dual-purpose of support and fluid conduction effect. The wick structures 8 are intended to increase the contact area between liquid and heat source, and to bring about the liquid conduction effect of condensate. The fluid conduction pillars 7 have no specific effect on heat transfer and hot spot. In another words, this prior art cooling device is ineffective at best.

The Taiwan Patent Serial No.88210055 discloses a cooling device comprising a chamber 9, an upper plate 10, and a lower plate 12, as shown in FIG. 4. The upper plate 10 is provided with a number of projections 11, whereas the lower plate 12 is provided with a wick structure 13 which comes in contact with the projections 11. The reflux and the conduction of condensate are attained by the wick structure 13. A support effect is jointly brought about by the wick structure 13 and the projections. In light of the wick structure 13 being relatively low in thermal conductivity, the wick structure 13 is in fact an obstacle to heat transfer. Both the wick structure 13 and the projections 11 are ineffective in terms of heat dissipation and uniform temperature distribution. In particular, this prior art cooling device is inefficient to deal with the problem of hot spot of electronic components.

SUMMARY OF THE INVENTION

The primary objective of the present invention is to provide a flat heat pipe which has a vacuum chamber and an appropriate amount of a working fluid contained in the vacuum chamber. The chamber is provided in an interior with a wick structure, by means of which a liquid/vapor dual phase cycle of the working fluid is attained. The chamber is further provided with a plurality of heat conduction pillars, which are located in a high-temperature area of the chamber such that the heat conduction pillars are in contact with an upper wall and a lower wall of the chamber. These heat conduction pillars are intended to enhance the heat transfer of the flat heat pipe of the present invention in such a way that they serve as heat transmission paths, and that they minimize obstruction to the heat transmission paths. As a result, the heat conduction pillars are capable of effective heat dissipation and uniform temperature distribution.

The heat conduction pillars of the flat heat pipe of the present invention are made of a material having a high thermal conductivity and are arranged in the areas which are relatively high in temperature. The heat conduction pillars are particularly effective to deal with the problem of hot spot.

Each of the heat conduction pillars of the present invention is reinforced by a wick structure which is used to promote a cyclic process of evaporation and condensation of the liquid. The liquid evaporation process brings about an excellent heat dispersion effect, thereby resulting in uniform temperature distribution. In another words, the wick structures work in conjunction with the heat conduction pillars to minimize an obstruction to heat transfer of the flat heat pipe of the present invention.

The features and the advantages of the present invention will be more readily understood upon a thoughtful deliberation of the following detailed description of the preferred embodiments of the present invention with reference to the accompanying drawings.

DETAILED DESCRIPTION OF THE PREFERRED EMBODIMENTS

Figure 1:
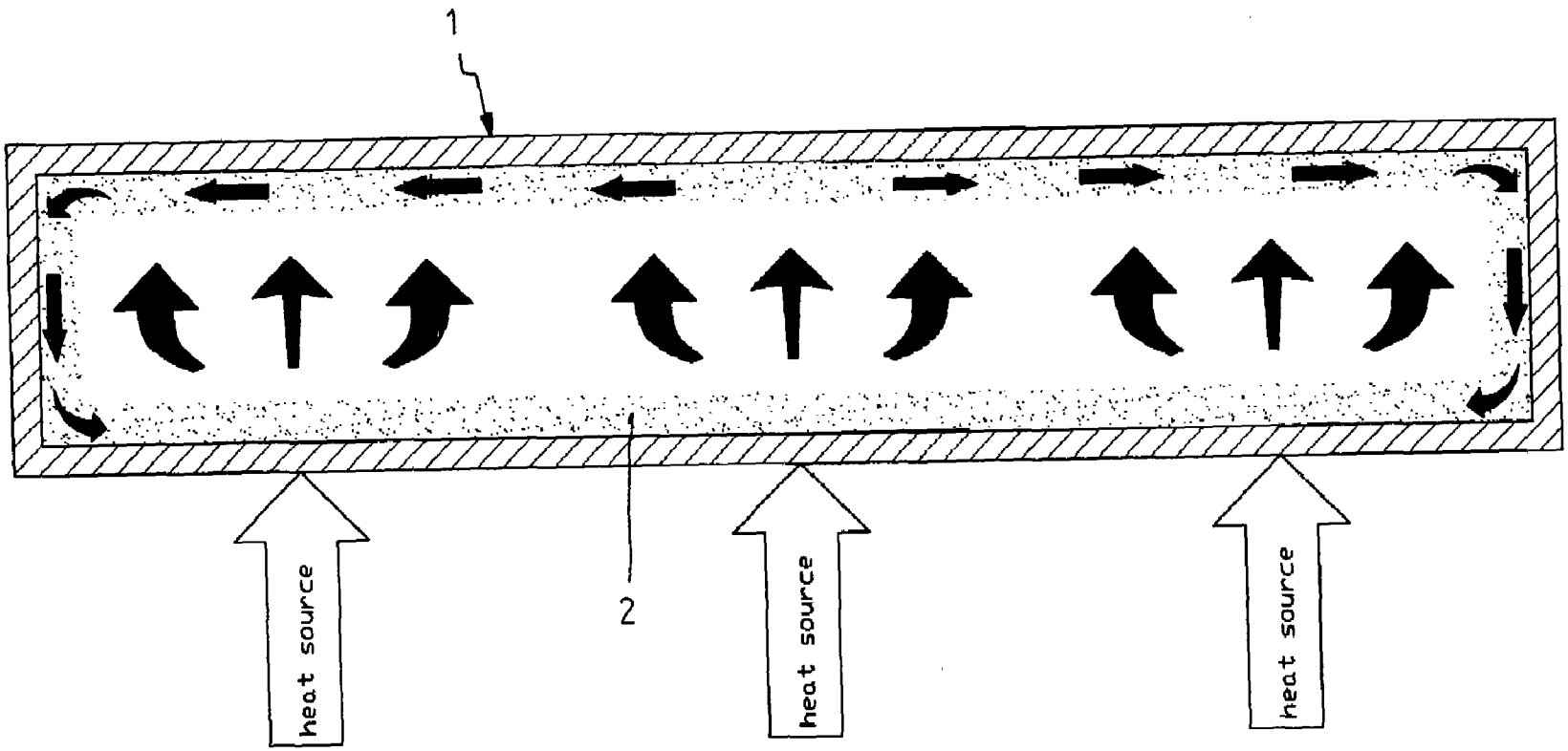
FIG. 1 PRIOR ART
FIG. 1 shows a schematic view of a condensation cycle of the prior art cooling devices.
Figure 2:
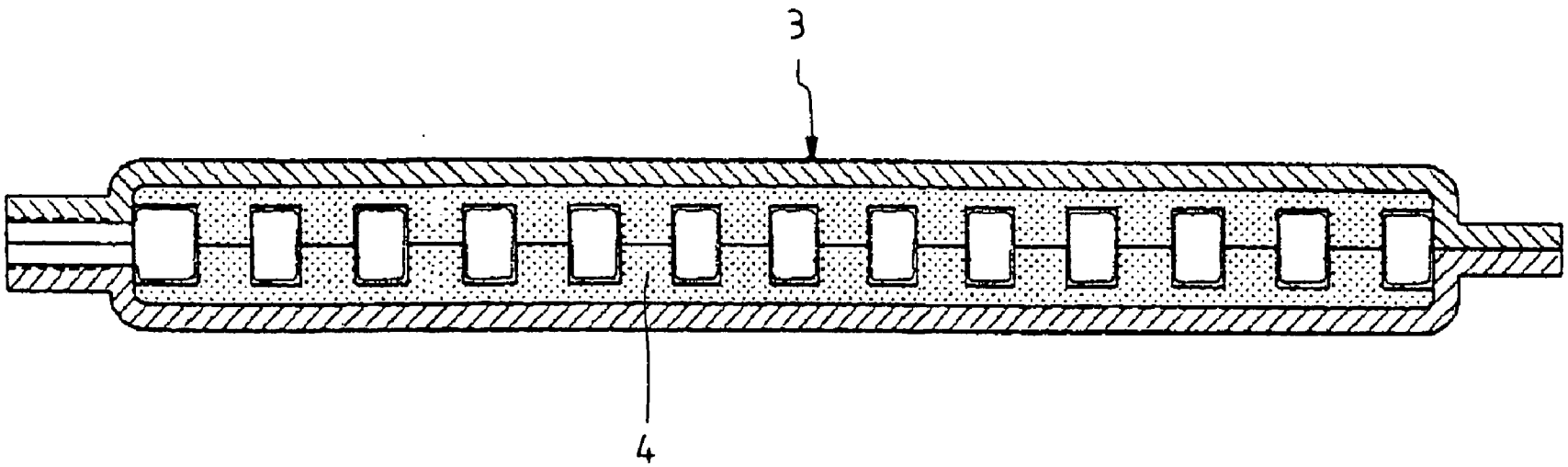
FIG. 2 PRIOR ART
FIG. 2 shows a schematic view of a cooling device disclosed in the Taiwan Patent Serial No.89210557.
Figure 3:
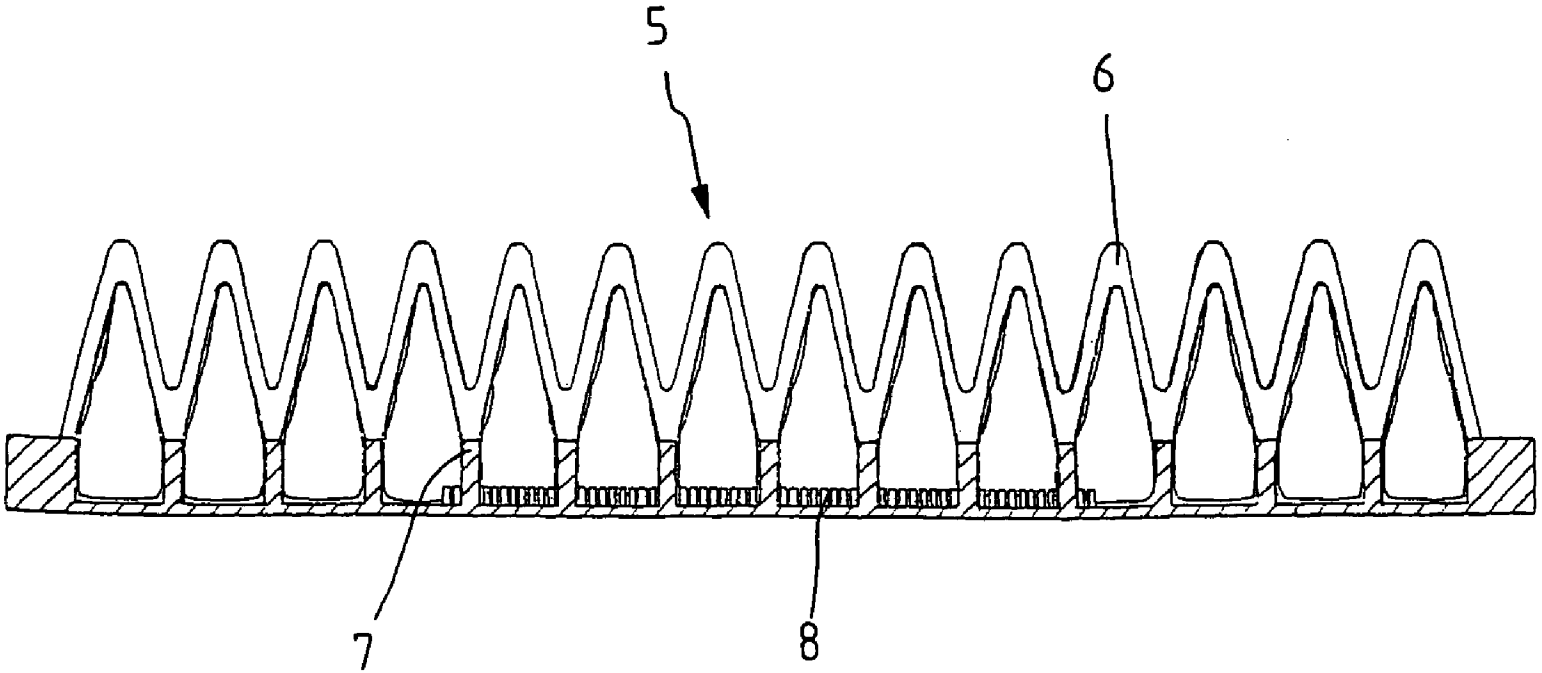
FIG. 3 PRIOR ART
FIG. 3 shows a schematic view of a cooling device disclosed in the Taiwan Patent Serial No.86115415.
Figure 4:
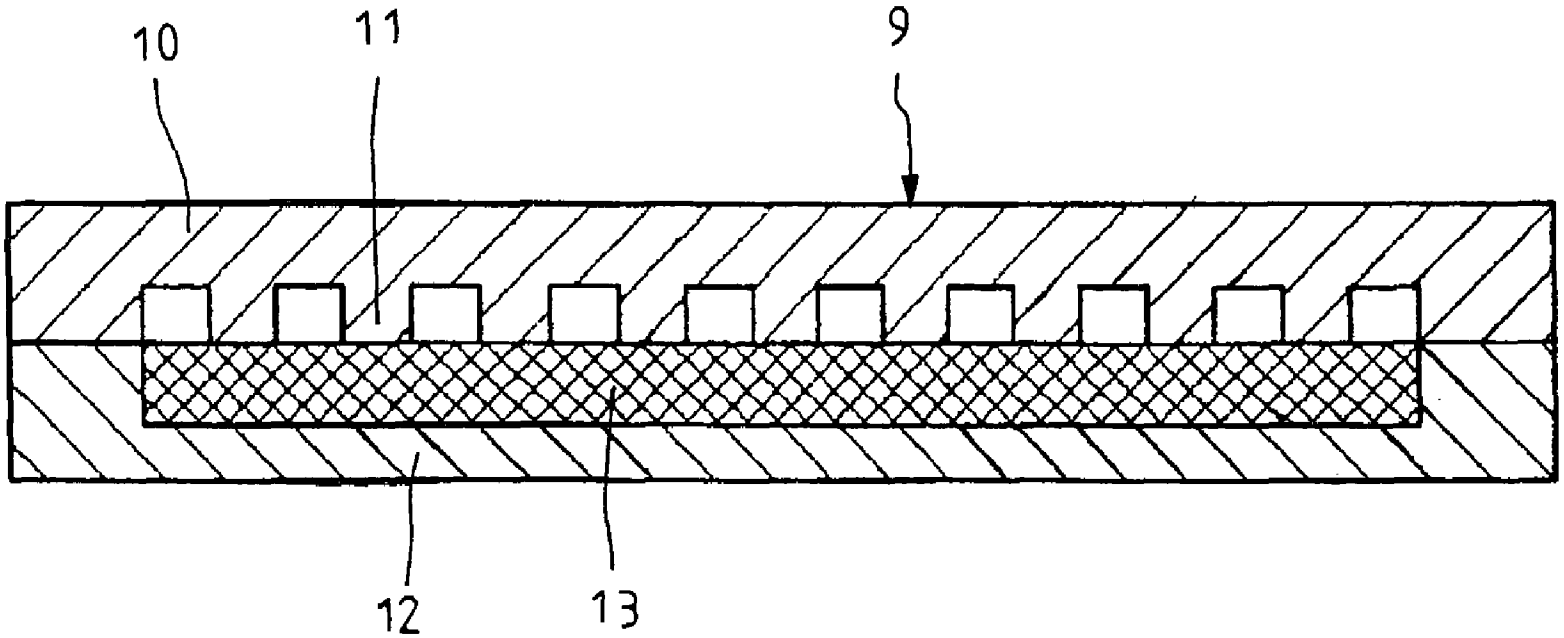
FIG. 4 PRIOR ART
FIG. 4 shows a schematic view of a cooling device disclosed in the Taiwan Patent Serial No.88210055.
Figure 5:
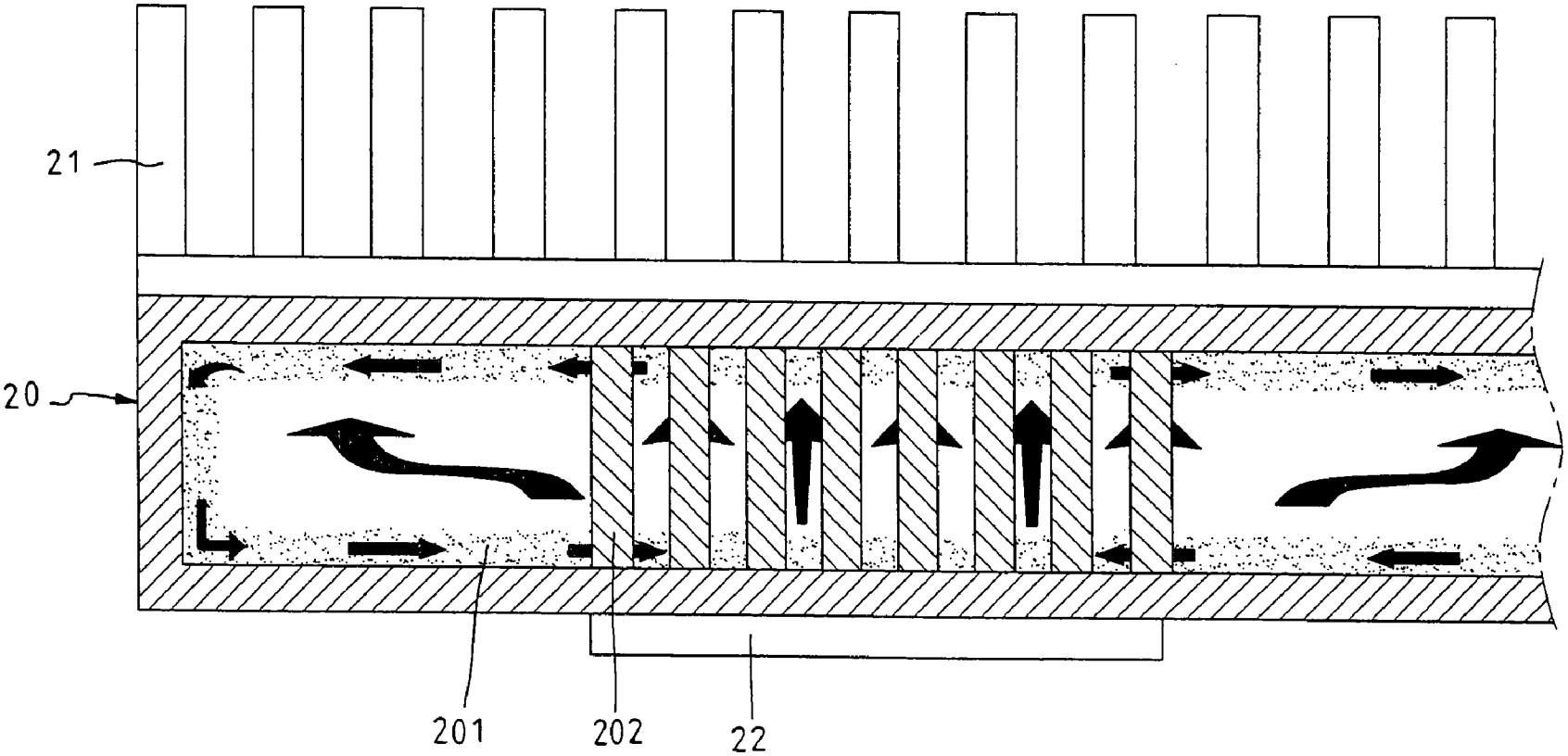
FIG. 5 shows a schematic view of a first preferred embodiment of the present invention.
Figure 6:
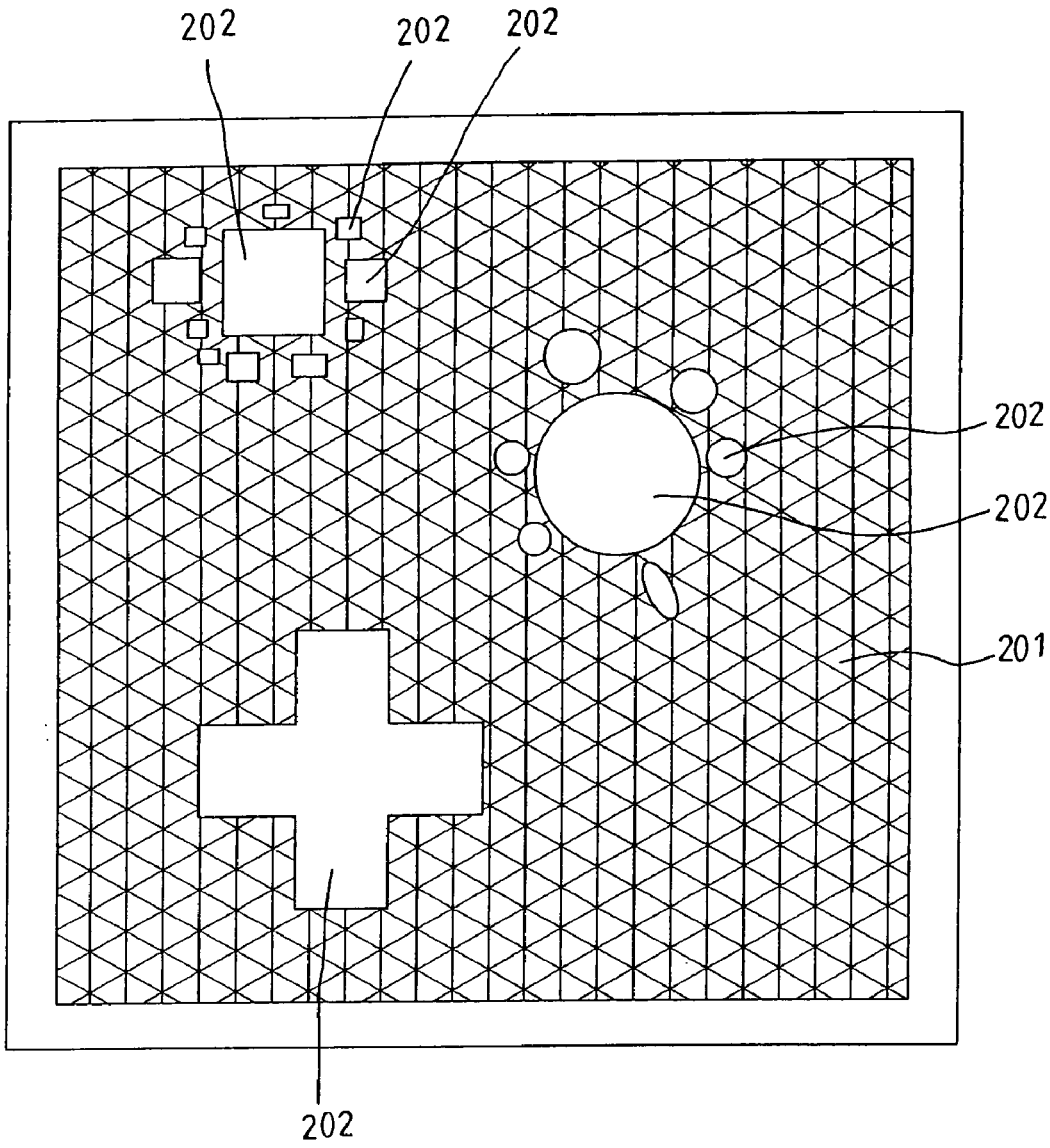
FIG. 6 shows a sectional schematic view of the first preferred embodiment of the present invention.

As shown in FIGS. 5 and 6, a flat heat pipe embodied in the present invention is provided with a vacuum chamber 20 which is made of a material having an excellent heat conduction property, such as copper, aluminium, and the like. A cooling device 21 is mounted on the vacuum chamber 20 which is connected at an underside thereof with a heating element 22.

The vacuum chamber 20 is provided in the surface of an interior thereof with a wick structure 201. An appropriate amount of a working fluid, such as pure water, ammonia, organic solution like methanol, ethanol or acetone, is contained in the chamber 20. The working fluid serves to disperse heat by evaporation and may contain metallic or nonmetallic powder in various ratios as desired. The working fluid is confined to the wick structure 201 by virtue of capillarity. As the working fluid comes in contact with the heat source, the working fluid is caused to evaporate such that the vapor rises to a cooler position, so as to form a condensate. The condensate is guided to the evaporation position by virtue of a capillary force which is brought about by the contact between the condensate and the wick structure 201. As a result, a liquid/vapor dual phase cycle is effected. In light of the wick structure 201 being relatively low in thermal conductivity, the wick structure 201 is not a good heat transfer medium. For this reason, the vacuum chamber 20 is further provided with a plurality of heat conduction pillars 202, which are located in an area in direct contact with the heat source 22 such that the heat conduction pillars 202 are in contact with an upper wall and a lower wall of the interior of the vacuum chamber 20. The heat conduction pillars 202 are made of a material having a high thermal conductivity. The heat conduction pillars 202 serve to enhance the heat transfer in such a manner that the heat energy of the heat source 22 is rapidly transferred to a condenser. It is therefore readily apparent that the flat heat pipe of the present invention is particularly effective in dealing with the problem of hot spot. In addition, the heat conduction pillars 202 of the present invention may be designed in such a pattern that they have various shapes and sizes, so as to maximize their heat transfer capability, as illustrated in FIG. 6.

Figure 7:
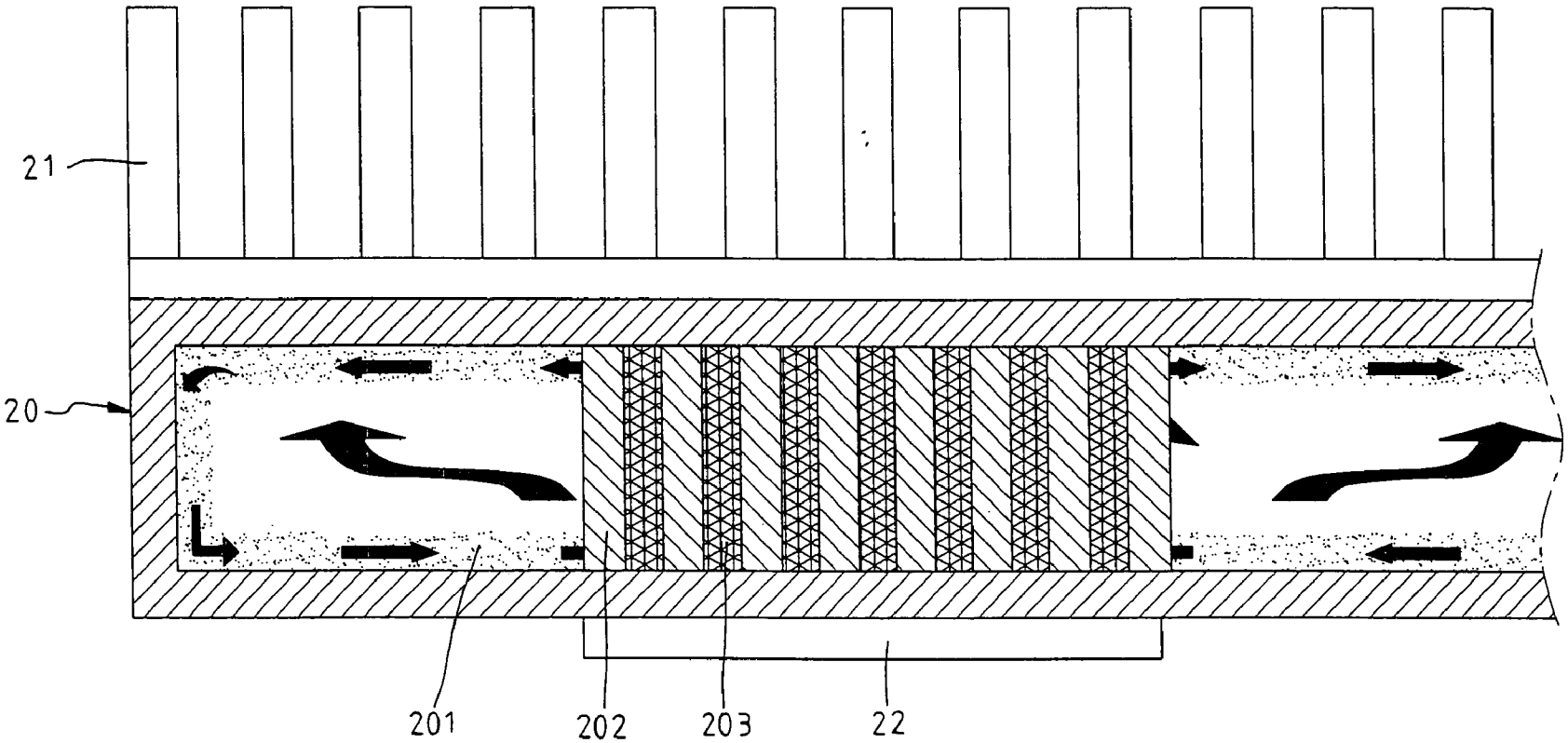
FIG. 7 shows a schematic view of a second preferred embodiment of the present invention.

As shown in FIG. 7, the vacuum chamber 20 of the present invention is further provided with a plurality of wick structures 203, which are arranged alternately with the heat conduction pillars 202. The wick structures 203 are of a porous medium made of a sintered metal powder. The wick structures 203 may also be made of a mesh or a metal spring. In light of the reinforcement of the heat conduction pillars 202 by the wick structures 203, a cyclic process of evaporation and condensation, which takes place along the heat conduction pillars 202, is greatly enhanced to promote the heat dispersion effect of the flat heat pipe of the present invention. Moreover, the wick structures 203 serve to promote the reflux of the condensate in such a way that the condensate is efficiently returned from the condenser to the evaporator, thereby resulting in an efficient circulation of the working fluid.

The wick structure may be taken a grooved or porous form by the heat conduction pillars 202 itself around which are not shown in the drawings.

Figure 8:
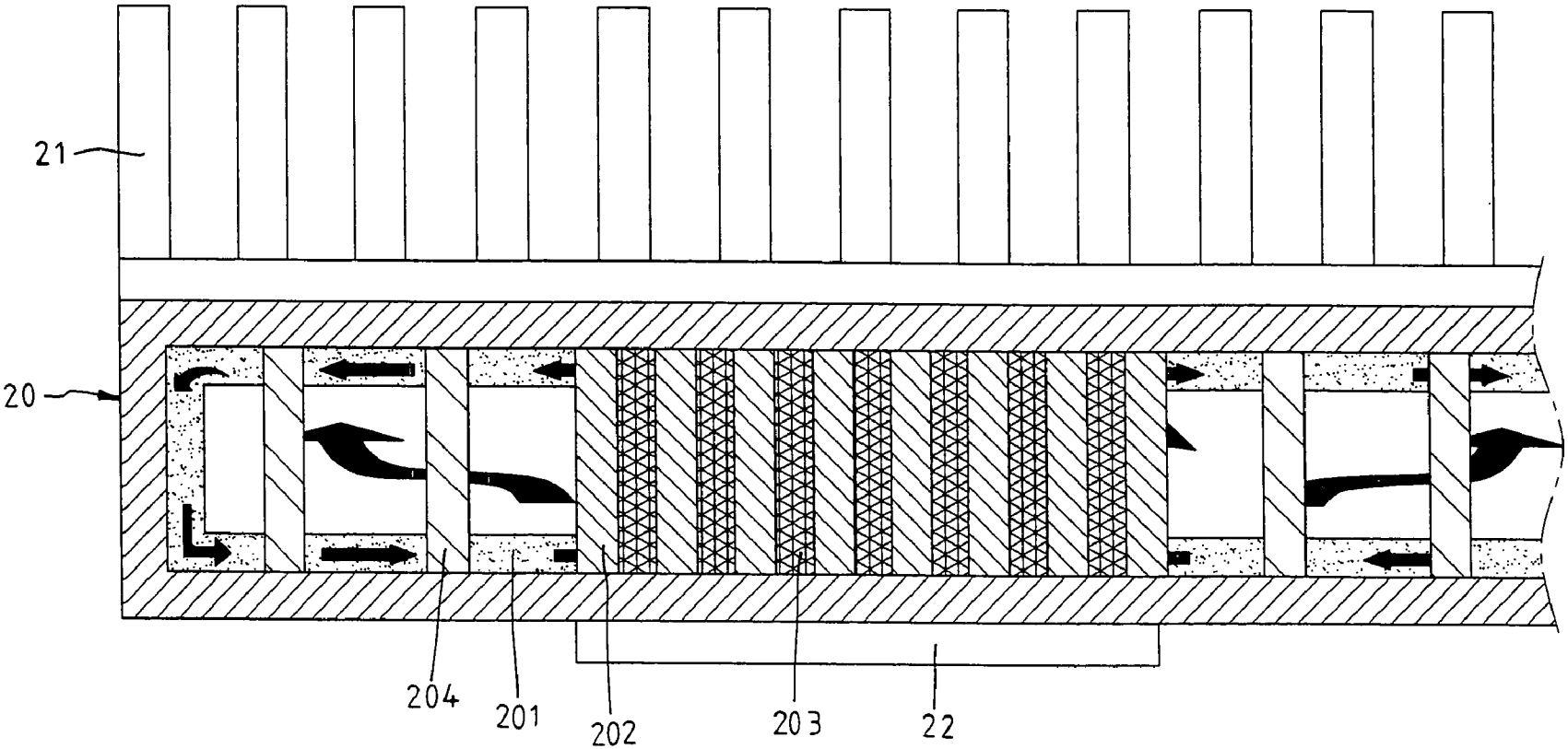
FIG. 8 shows a schematic view of a third preferred embodiment of the present invention.

As shown in FIG. 8, the vacuum chamber 20 of the present invention is further provided with a plurality of supported pillars 204, which are arranged in the hollow interior of the chamber 20 to provide the chamber 20 with protection against damage or deformation of the chamber 20. In another words, the supported pillars 204 serve to protect the structural integrity of the chamber 20 which is vulnerable to damage or deformation caused by atmospheric pressure.

The embodiments of the present invention described above are to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A flat heat pipe having a vacuum chamber which is provided with an evaporator in contact with a heating element, and a condenser connected to a cooling device, said vacuum chamber being provided in a hollow interior with a first wick structure, and a predetermined amount of a working fluid by which an evaporation-condensation cycle is effected;

wherein said vacuum chamber is provided in the hollow interior with a plurality of heat conduction pillars;

said heat conduction pillars are in contact with an upper wall and a lower wall of the hollow interior of said vacuum chamber, and said heat conduction pillars are disposed only within a central section of the flat heat pipe so as to allow condensates to be collected around both sides of the upper wall of the flat heat pipe;

further wherein said flat heat pipe further comprises a plurality of second wick structures arranged alternately with the heat conduction pillars, said second wick structures being made of a material different from said first wick structure and;

at least some of said heat conduction pillars have different cross-section area and shape from other heat conduction pillars.

2. The flat heat pipe as defined in claim 1, wherein said heat conduction pillars are made of a material having a high thermal conductivity.

3. The flat heat pipe as defined in claim 1, wherein said wick structures are of a porous medium made of a sintered metal powder.

4. The flat heat pipe as defined in claim 1, wherein said wick structures are of a mesh or metal spring.

5. The flat heat pipe as defined in claim 1, wherein said heat conduction pillars have a grooved or porous structure to enhance the evaporation-condensation cycle.

6. The flat heat pipe as defined in claim 1 which further comprises support pillars disposed to provide structural support.

* * * * *